US005666845A

United States Patent [19]

Thomas

[11] Patent Number: 5,666,845

[45] Date of Patent: Sep. 16, 1997

[54] ROLLING MILL

[75] Inventor: John E. Thomas, Pittsburgh, Pa.

[73] Assignee: Tippins Incorporated, Pittsburgh, Pa.

[21] Appl. No.: 589,913

[22] Filed: Jan. 23, 1996

[51] Int. Cl.[6] ..... B21B 31/07; B21B 31/24

[52] U.S. Cl. ..... 72/238; 72/237; 72/248

[58] Field of Search ..... 72/237, 238, 239, 72/241.8, 245, 247, 248

[56] References Cited

U.S. PATENT DOCUMENTS

| | | | |
|---|---|---|---|
| 355,390 | 1/1887 | Daniels | 72/238 |
| 759,326 | 5/1904 | Swindell | 72/248 |
| 1,125,984 | 1/1915 | Dumas | 72/178 |
| 1,900,032 | 3/1933 | Worthington | 72/243.6 |
| 1,943,142 | 1/1934 | Peters | 384/253 |
| 2,271,459 | 1/1942 | McConnell | 72/241.2 |
| 2,374,802 | 5/1945 | Breuer | 72/225 |
| 3,364,715 | 1/1968 | O'Brien | 72/245 |
| 3,659,450 | 5/1972 | Metzger | 72/237 |
| 3,670,644 | 6/1972 | Hoever et al. | 72/240 |
| 3,712,102 | 1/1973 | Eibe | 72/238 |
| 3,813,912 | 6/1974 | Matsufuji et al. | 72/224 |
| 3,882,710 | 5/1975 | Kersting | 72/237 |
| 4,007,822 | 2/1977 | Scheurecker | 72/248 |
| 4,103,528 | 8/1978 | Okuda et al. | 72/238 |
| 4,182,148 | 1/1980 | Gilvar | 72/228 |
| 4,368,633 | 1/1983 | Nogota | 72/239 |
| 4,399,680 | 8/1983 | Hartmann et al. | 72/225 |
| 4,587,702 | 5/1986 | Kates | 29/401.1 |
| 4,770,021 | 9/1988 | Kobayashi et al. | 72/245 |
| 5,052,206 | 10/1991 | Reismann et al. | 72/13.4 |

*Primary Examiner*—Lowell A. Larson
*Assistant Examiner*—Rodney A. Butler
*Attorney, Agent, or Firm*—Webb Zeisenheim Bruening Logsdon Orkin & Hanson, P.C.

[57] ABSTRACT

A rolling mill of the present invention includes a mill stand formed by two spaced apart housings. The housings are configured to rotatably hold one of at least two sets of rolls. A hold-down assembly is coupled to the housings. The hold-down assembly includes at least a first pair of hold-down screws and a second pair of hold-down screws. The distance between the screws of the first pair of hold-down screws is less than the distance between the screws of the second pair of hold-down screws. Each pair of hold-down screws is selectively adapted to substantially align with the bearing chocks of an adjacent roll of one of the sets of rolls in the mill stand.

10 Claims, 10 Drawing Sheets

ROLLING MILL

BACKGROUND OF THE INVENTION

1. Field of the Invention

This invention relates generally to rolling mills and, more particularly, to a four-high rolling mill which can be converted between a hot mill configuration for rolling relatively narrow products, such as hot mill band or plate in coil form, and a plate mill configuration for rolling relatively wide products, such as wide plate.

2. Description of the Prior Art

Many different types of rolling mills are known in the art for rolling various products, such as steel plates, coils, strips and the like. Typical examples of rolling mills include two-high, three-high and four-high mills. As the names indicate, these classifications are based on the manner of arranging the rolls in the housings. A four-high mill has four rolls arranged one above the other. Four-high mills are used for rolling flat material, like sheets and plates, and represent a special type of mill for both hot and cold rolling. In a four-high mill, large backup rolls are used to reinforce smaller work rolls. Either the backup or work rolls may be driven. Four-high mills generally resist the tendency of long work rolls to deflect and permit the use of small diameter work rolls for producing wide plates and hot or cold rolled strip and sheets of uniform gauge.

A typical four-high mill consists of a mill stand formed by a pair of spaced apart housings mounted on a base. Each housing consists of a pair of upright standards or legs having an opening or window which extends therebetween. A pair of work rolls and a pair of backup rolls are rotatably carried in the mill stand. The window serves as a receptacle for the bearing blocks of the work and backup rolls. A hold-down or screw-down mechanism is used to adjust the distance between the work rolls. The screw-down mechanism consists of a single pair of screws with one screw on each side of the mill stand and extending down through the top of the mill stand. The screws push down on the opposed bearing blocks of the top backup roll and thus adjust the distance between the work rolls. On small mills where adjustments are only occasionally made, these screws are operated by hand with spanner bars. In larger mill stands, hydraulic or electric drives may be used to turn the screw-down mechanism. In typical rolling operations, a series of mill stands are spaced closely together in one continuous line so that the product is being rolled concurrently in more than one mill stand as it passes in a straight line from one stand to the next. Such an arrangement is known as a tandem mill.

Four-high mills for rolling heated slabs are typically used for two different kinds of rolling applications. These are known in the art as "hot mills" and "plate mills" and are typically thickness and width dependent. A hot mill has relatively short work and backup rolls and is used to roll products having a thickness capable of being coiled and a maximum width of about 80 inches, with a typical width of about 56 inches. A plate mill has relatively longer work and backup rolls and is used to roll a thicker product, such as ¾ inch and thicker, and much wider products, for example, about 132 inches. Because of their width restriction, hot mills are not capable of being used as plate mills. Also, plate mills cannot effectively be used as hot mills because trying to roll a narrow product causes the relatively longer backup rolls of the hot mill to deflect or arc under the pressure of the screw-down mechanism thus causing the backup rolls to lose their stiff contact with the entire length of the work rolls. Therefore, it is standard practice in the art to have separate mill stands for hot mill and plate mill rolling operations. For mill owners, the requirement to have separate hot mills and plate mills can be a large drain on operating costs unless the product mix is sufficient to maintain both types of rolling operations simultaneously. Also, the large initial expenditure of capital needed to purchase both hot mills and plate mills is quite burdensome.

Therefore, it is an object of the present invention to provide a four-high mill stand which can be quickly and easily converted between hot mill and plate mill configurations.

It is a further object of the invention to provide a screw-down assembly which can be used with either the present invention or which can be economically retrofitted onto an existing mill stand to allow for conversion of the mill stand between hot mill and plate mill configurations.

It is also an object of the present invention to provide a method for converting a mill stand between hot mill and plate mill configurations.

SUMMARY OF THE INVENTION

A rolling mill of the present invention includes a mill stand formed by two spaced apart housings. The housings are configured to rotatably hold one of at least two sets of rolls having roll necks. A hold-down assembly is coupled to the housings. The hold-down assembly includes at least a first pair of hold-down elements and a second pair of hold-down elements. The distance between each hold-down element of the first pair of hold-down elements is less than the distance between each hold-down element of the second pair of hold-down elements. Each pair of hold-down elements is selectively adapted to substantially align with the roll necks of at least the roll adjacent the hold-down assembly.

The present invention also includes a method of converting a rolling mill between a first rolling configuration and a second rolling configuration. The method includes the steps of selectively retracting one of a first pair and second pair of hold-down elements, removing a first set of rolls from the rolling mill, inserting a second set of rolls into the rolling mill and selectively extending the other of the first pair and second pair of hold-down elements.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
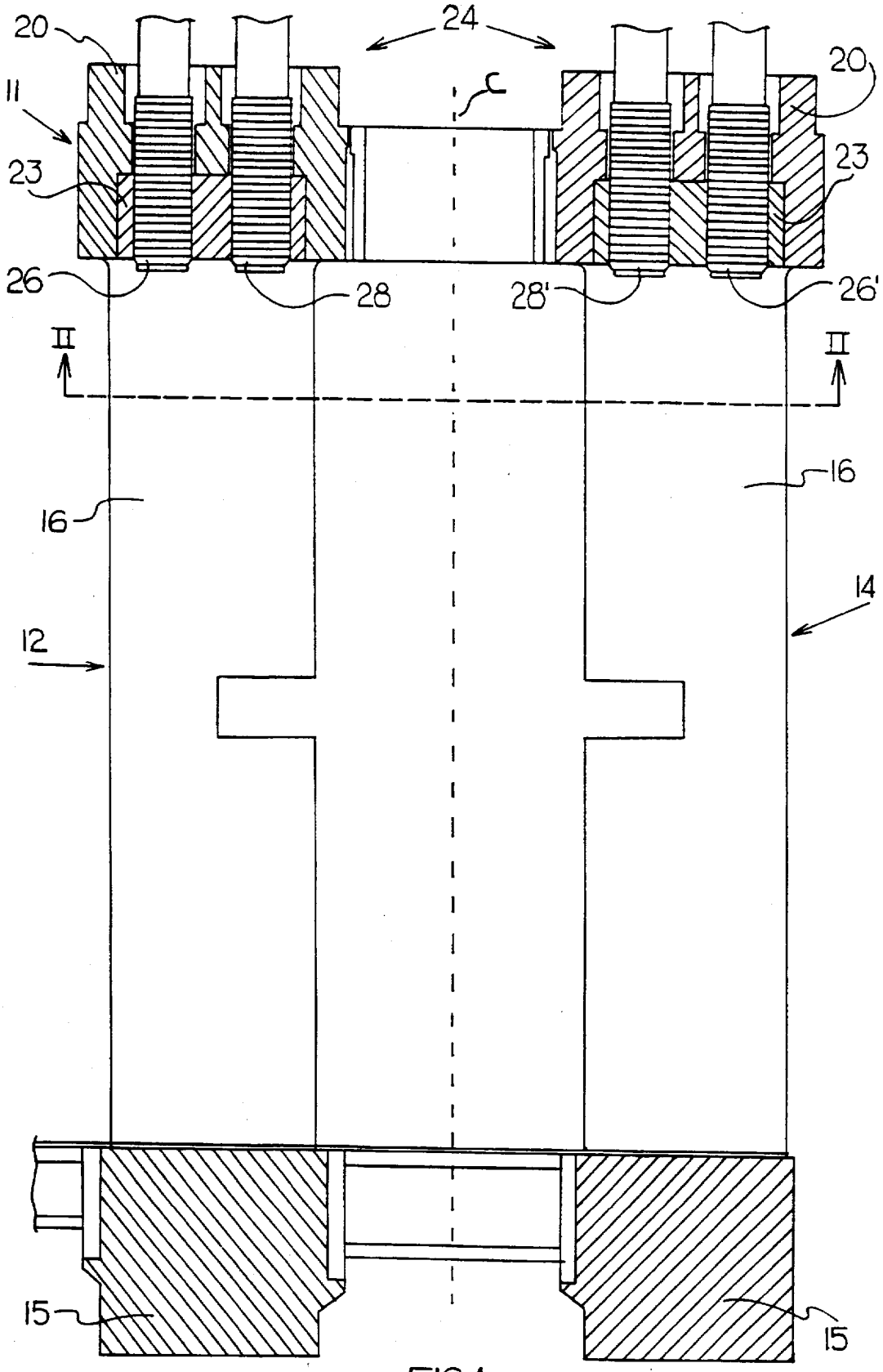
FIG. 1 is a front, sectional view of a rolling mill stand according to the present invention.
Figure 2:
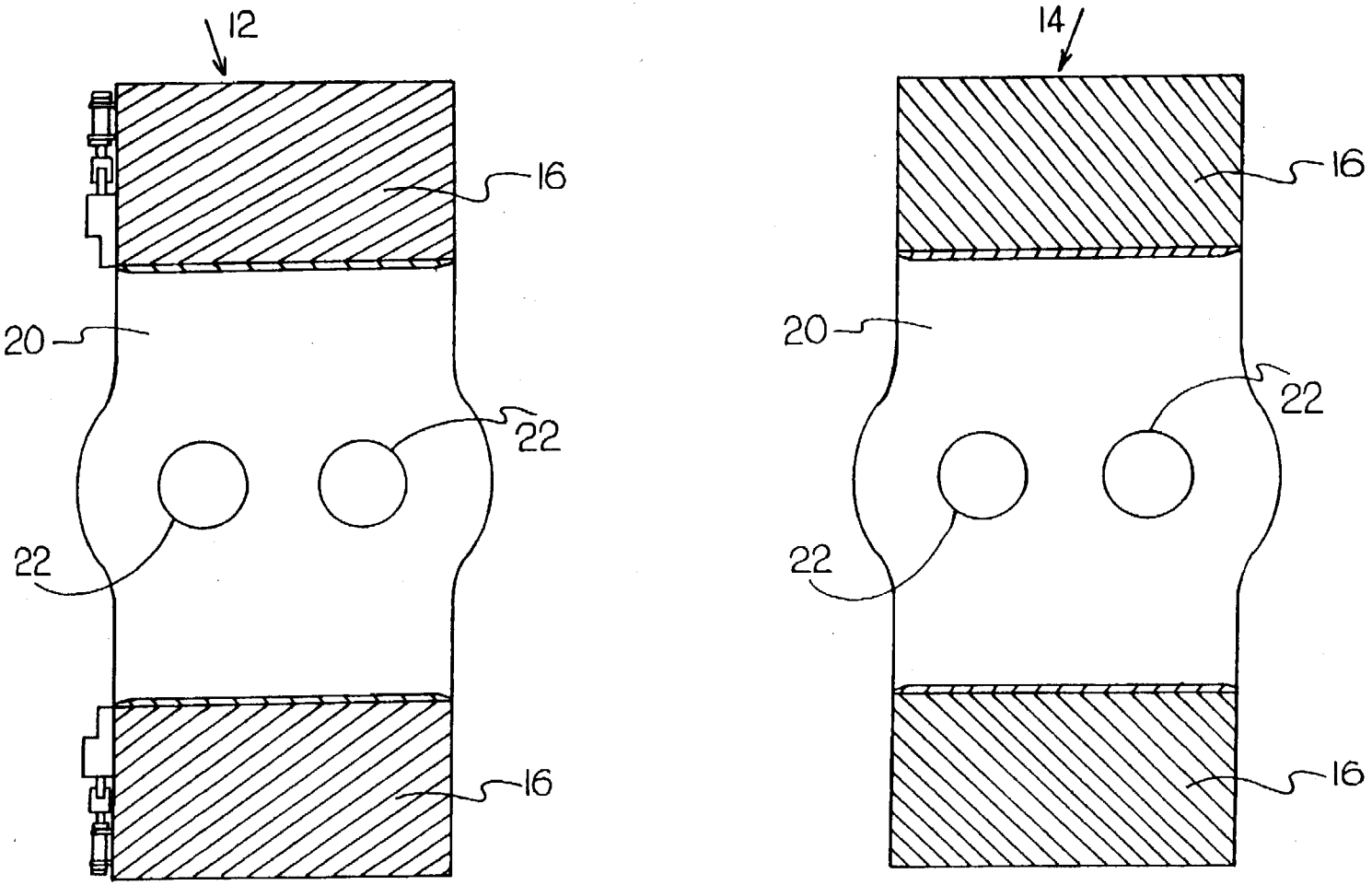
FIG. 2 is a sectional view of the mill stand of FIG. 1 taken along the line II—II.

A convertible four-high rolling mill of the present invention is generally designated 10 in FIGS. 3, 4, 5 and 6 of the drawings. As shown in FIGS. 1 and 2, the rolling mill 10 includes a rolling mill stand 11 having a centerline C and formed by two spaced apart housings 12 and 14 mounted on a base 15. Each housing 12, 14 includes a pair of vertically extending, substantially parallel standards or legs 16 with an opening or window located between the legs 16 of each housing 12 and 14. A cap 20 is attached to the top of each housing 12 and 14 and extends between the legs 16 of that housing 12 and 14. Each cap 20 has a hold-down block 23 and a pair of threaded bores 22 extending through the cap 20. The caps 20 support a hold-down assembly 24. The hold-down assembly 24 includes a pair of first or outer hold-down elements or screws 26, 26' and a pair of second or inner hold-down elements or screws 28, 28'. Each pair of hold-down screws 26, 26' and 28, 28' may be operable as a pair or individually by conventional drive assemblies, such as manual, hydraulic or electrical drive assemblies, which are known in the art. While the preferred embodiment of the hold-down assembly utilizes hold-down screws 26, 26', 28, 28', other hold-down elements, for example, hydraulic pistons, may be used.

Figure 3:
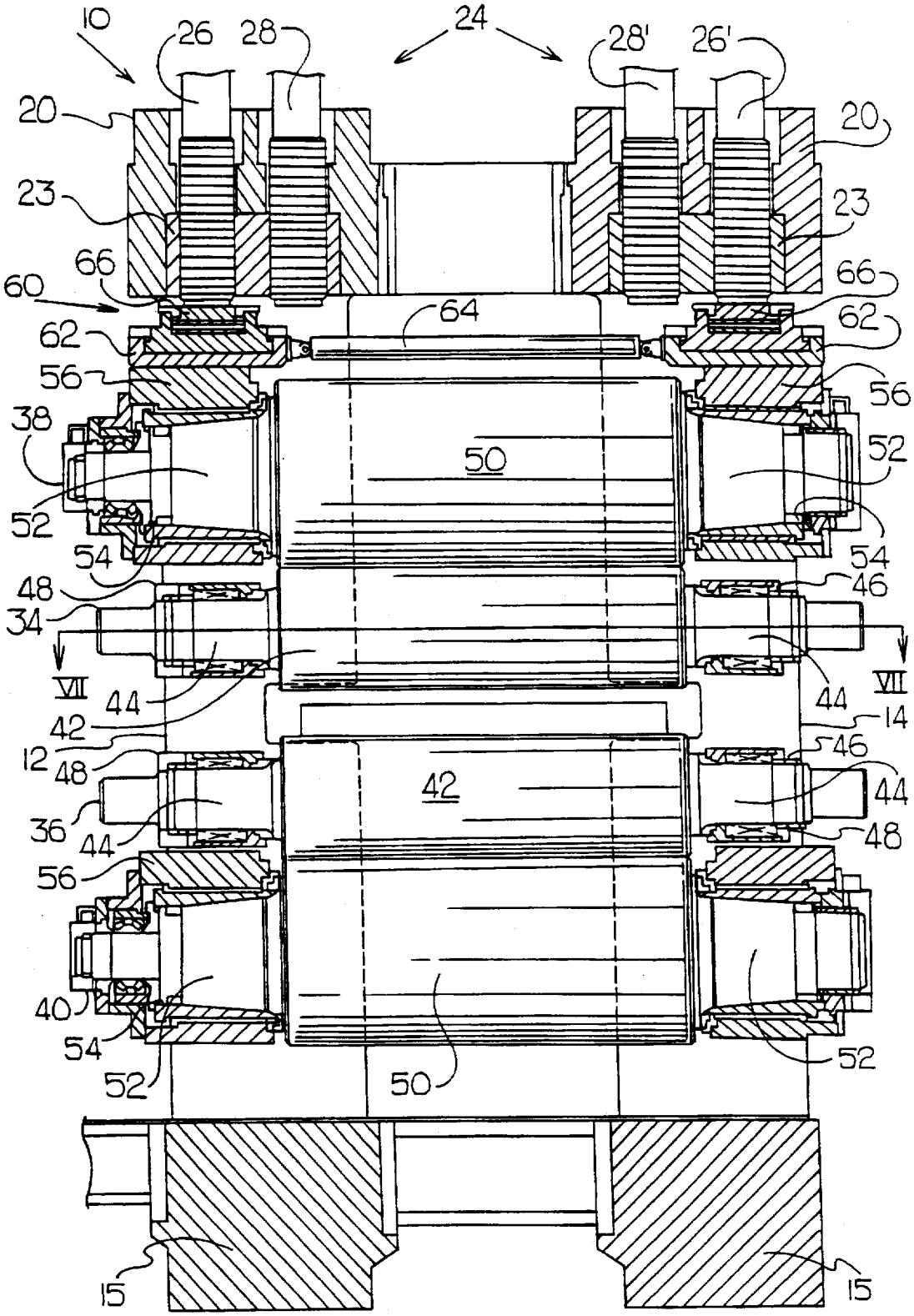
FIG. 3 is a front, sectional view of a plate mill configuration according to the present invention.
Figure 4:
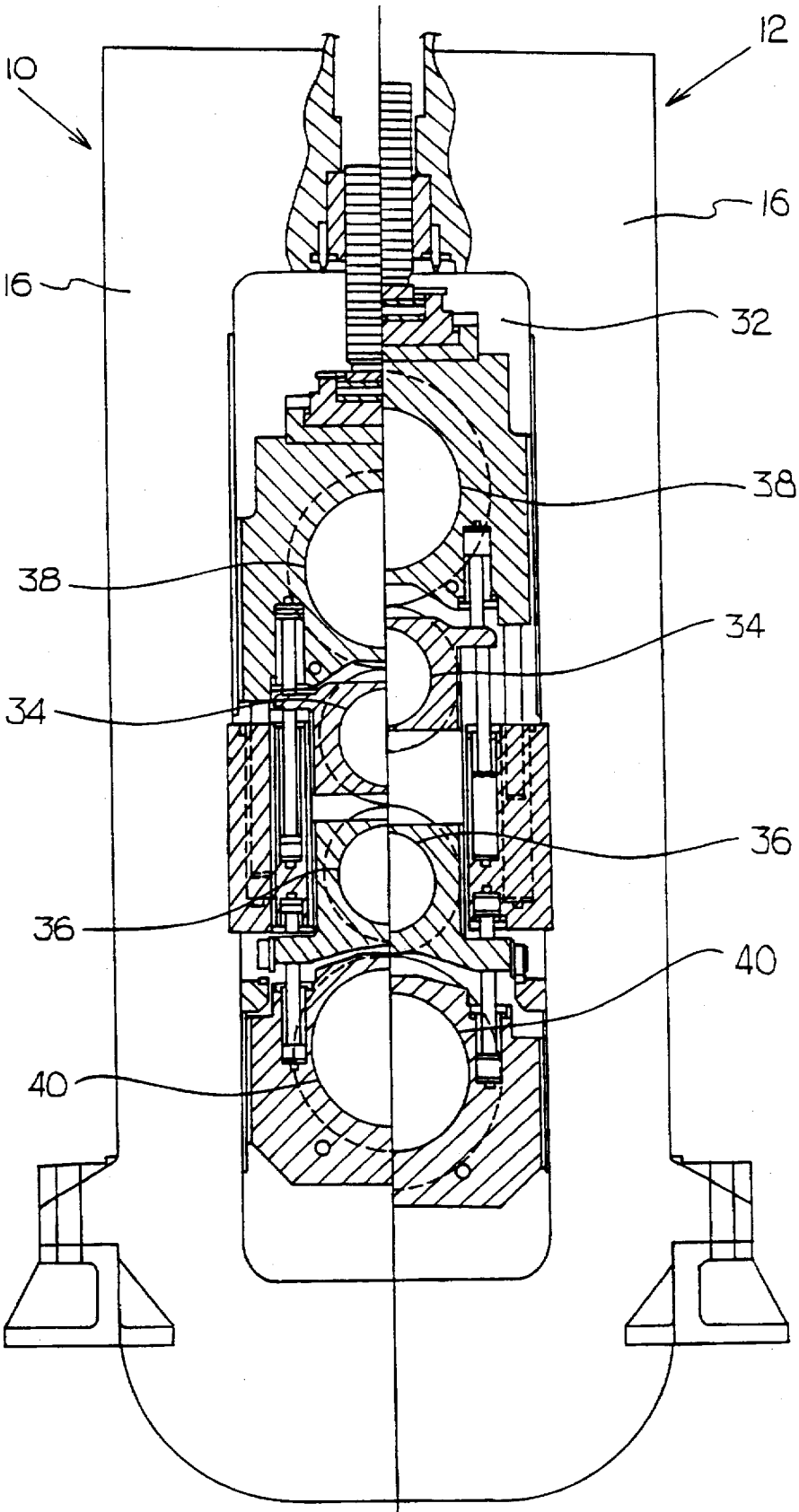
FIG. 4 is a side view of the plate mill configuration of FIG. 3 shown in two working conditions.

FIGS. 3 and 4 show the rolling mill 10 of the present invention in a plate mill configuration to work relatively wide products. In this configuration, a set of plate mill rolls is rotatably carried in the mill stand 11. The set of plate mill rolls include a pair of plate mill work roll assemblies 34 and 36 and a pair of plate mill backup roll assemblies 38 and 40 which are supported within the window 32 located between the legs 16 of each of the housings 12 and 14. Each plate mill work roll assembly 34 and 36 includes a work roll 42 having a work roll neck 44 located at each end of the work roll 42. Each work roll neck 44 is rotatably carried in a work roll bearing assembly 46 and the work roll bearing assemblies 46 are each carried in work roll bearing chocks 48. The work roll bearing assemblies 46 and the bearing chocks 48 may be of any type conventionally used in the art. As shown in FIG. 3, one of the outer hold-down screws 26, 26' and one of the inner hold-down screws 28, 28' are threadably carried in a common hold-down block 23.

Each plate mill backup roll assembly 38 and 40 includes a backup roll 50 having opposed backup roll necks 52. Each backup roll neck 52 is rotatably carried in a backup roll bearing assembly 54 which is in turn carried in a backup roll bearing chock 56. The backup roll bearing assemblies 54 and bearing chocks 56 may be of any conventional type.

A plate mill breaker block assembly 60 abuts the upper surface of the bearing chocks 56 of the topmost backup roll assembly 38. The breaker block assembly 60 includes a pair of breaker block holders 62 having a tie bar 64 extending therebetween. Each breaker block holder 62 contains at least one breaker block 66. As shown in FIG. 3, in the plate mill configuration, the roll necks, breaker block holders 62 and the work roll and backup roll bearing chocks 48 and 56 are substantially vertically aligned with the outer set of hold-down screws 26 and 26'.

Figure 7:
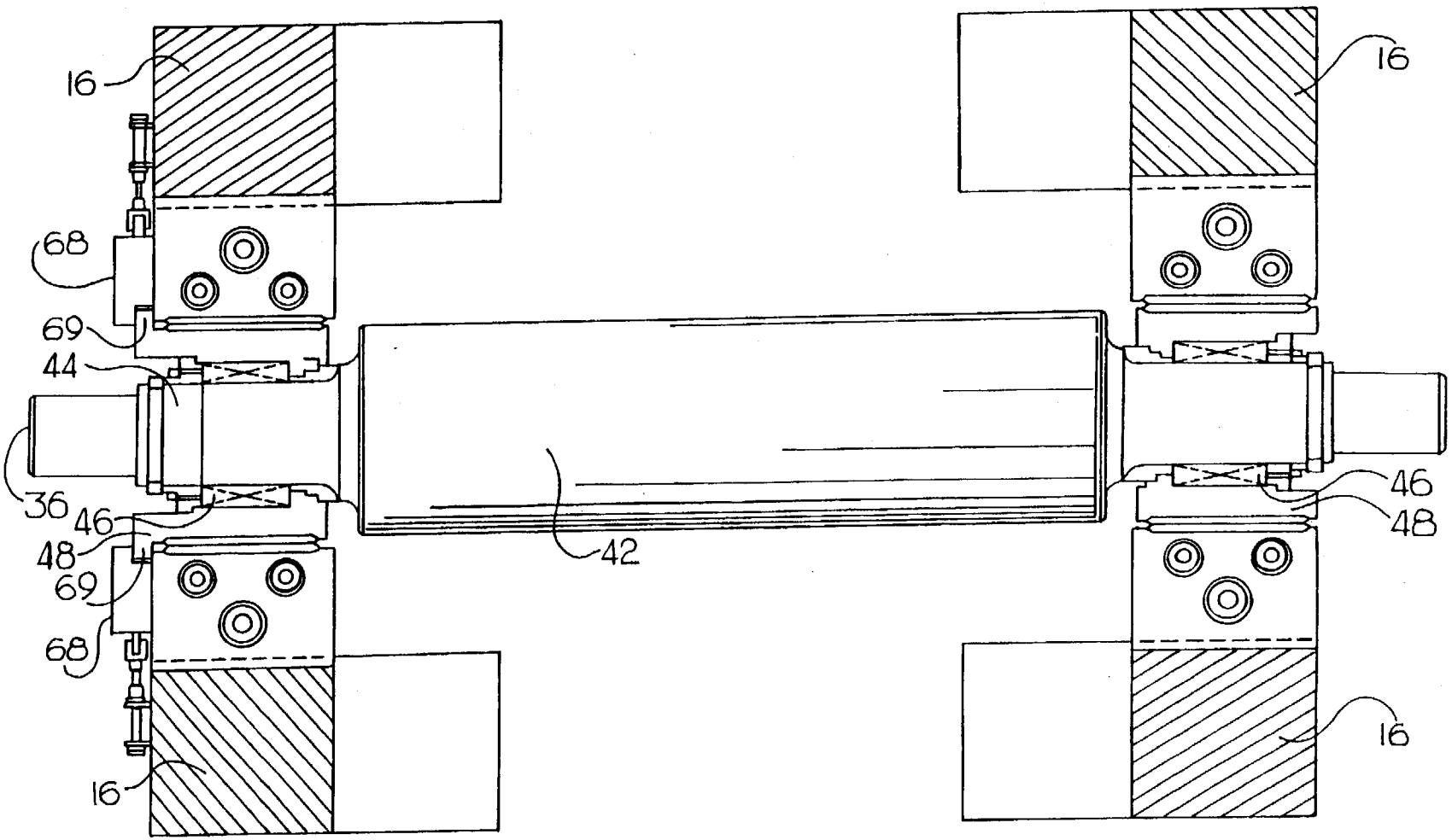
FIG. 7 is a sectional view of a plate mill work roll of FIG. 3 taken along the line VII—VII.

As shown in FIG. 7, the plate mill work roll bearing chocks 46 may be held in place by a pair of clamping members 68 which are mounted on the opposing legs 16 of the housing 12, 14 and which are configured to engage tabs 69 on one of the bearing chocks 46. A similar locking arrangement may be used to lock the plate mill backup rolls 50 in the mill stand 11. Alternatively, any type of conventional locking mechanism may be used.

Figure 5:
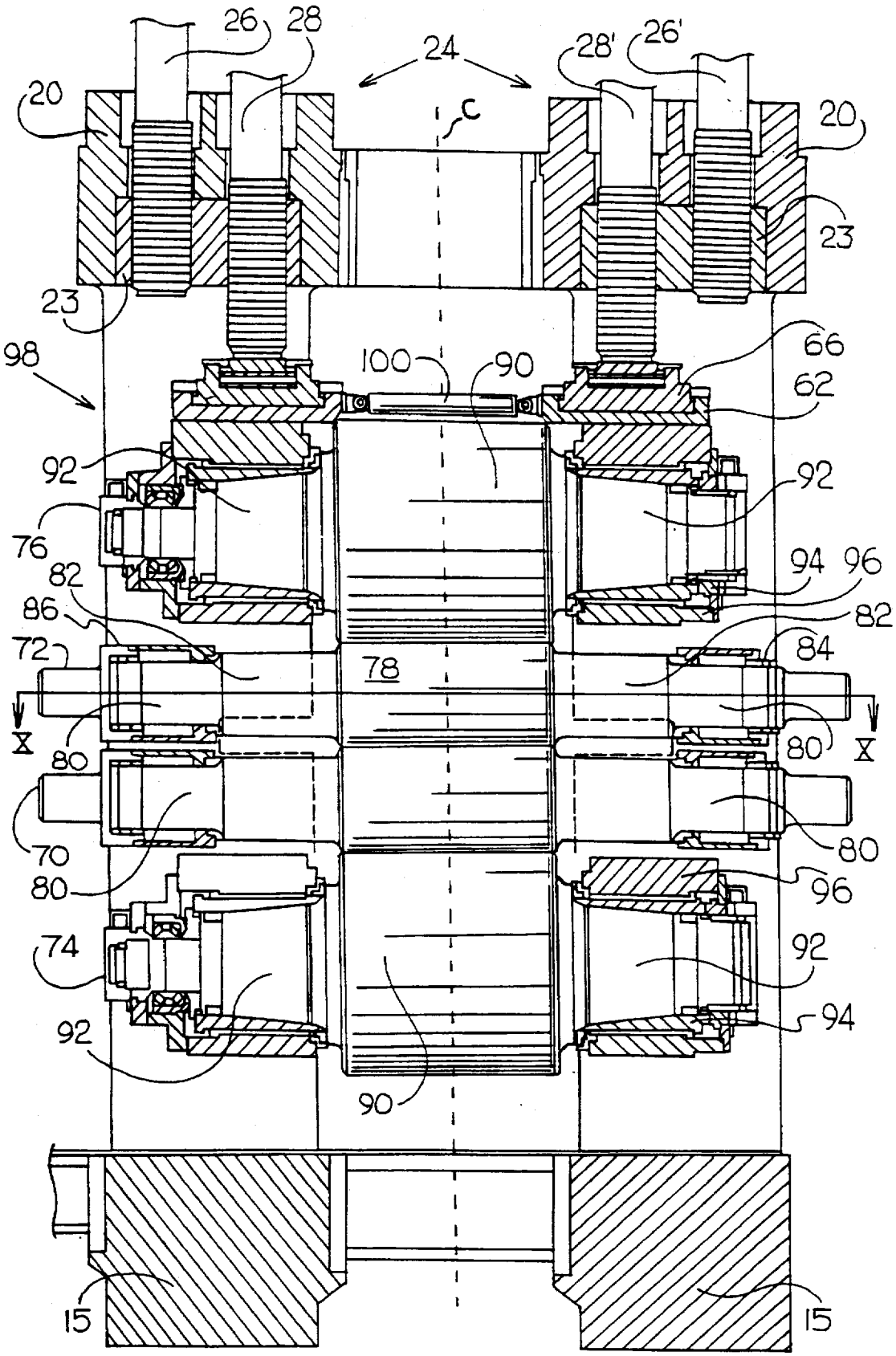
FIG. 5 is a hot mill configuration according to the present invention.
Figure 6:
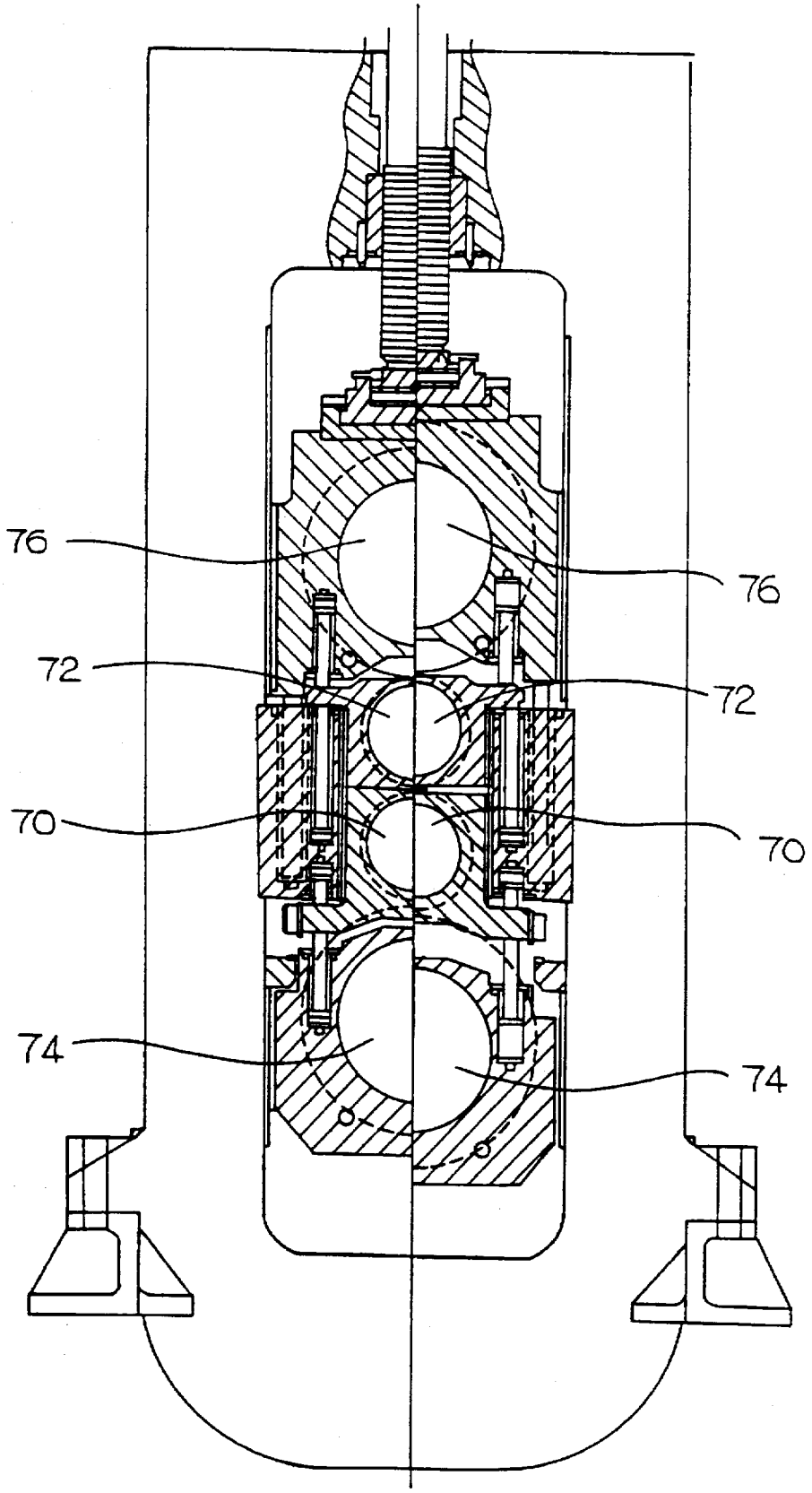
FIG. 6 is a side view of the hot mill configuration of FIG. 5 shown in two working conditions.
Figure 10:
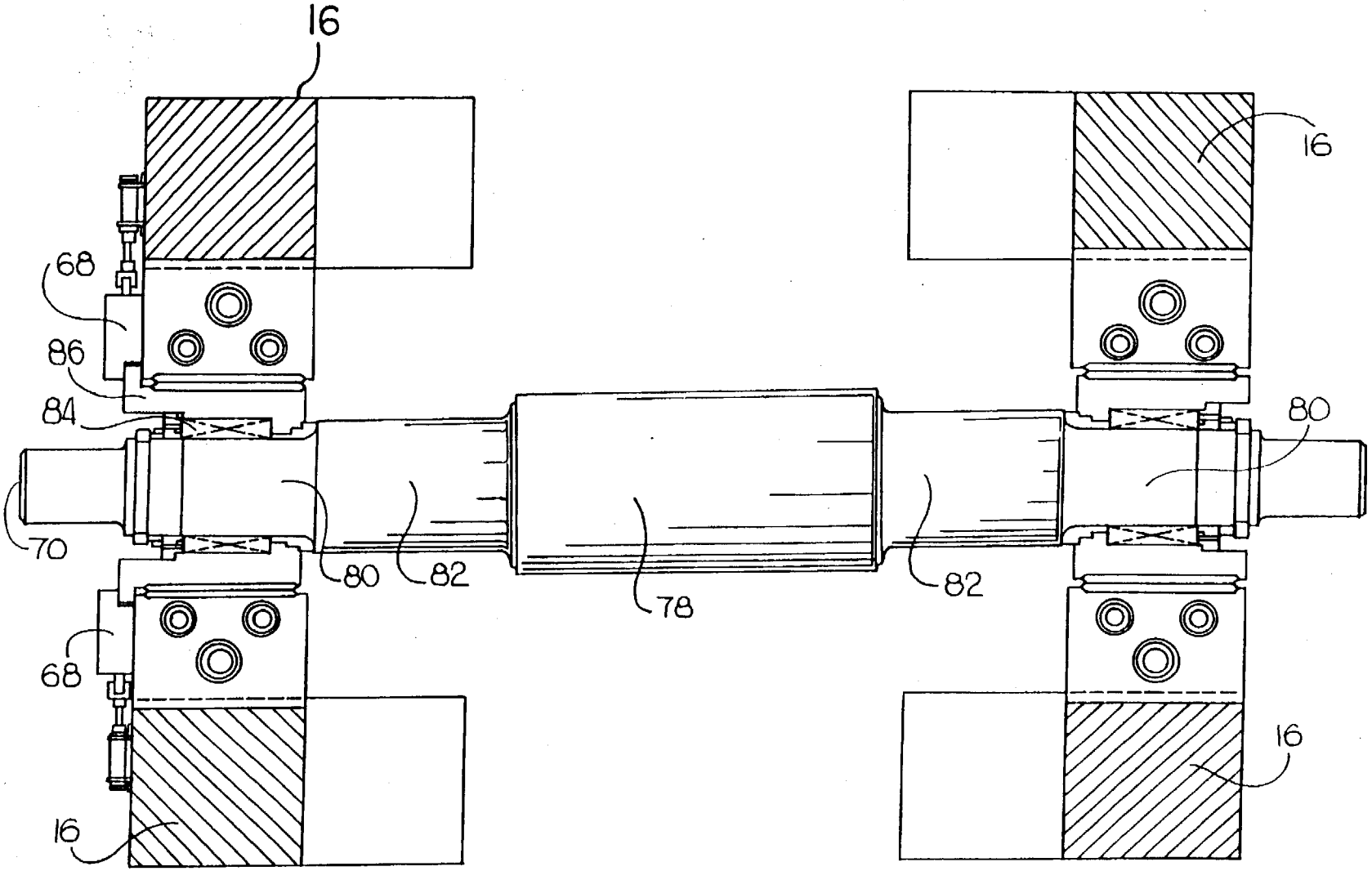
FIG. 10 is a sectional view of a hot mill work roll of FIG. 5 taken along the line X—X.

A hot mill configuration of rolling mill 10 having a set of hot mill rolls is mounted in the mill stand 11 as shown in FIGS. 5 and 6. In the hot mill configuration, the plate mill work roll and backup roll assemblies 34, 36, 38 and 40 are replaced by a pair of hot mill work roll assemblies 70 and 72 and a pair of hot mill backup roll assemblies 74 and 76. As shown in FIGS. 5, 6 and 10, each hot mill work roll assembly 70 and 72 includes a hot mill work roll 78 having a work roll neck 80 located at each end of the work roll 78. A stepped or intermediate region 82 is located between the work roll 78 and work roll necks 80. The work roll necks 80 are rotatably carried in work roll bearing assemblies 84 which are in turn carried in work roll bearing chocks 86. Each hot mill backup roll assembly 74 and 76 includes a backup roll 90 having a backup roll neck 92 located at each end of the backup roll 90. Each backup roll neck 92 is rotatably carried in a backup roll bearing assembly 94 which is in turn carried in a backup roll bearing chock 96. As in the plate mill configuration, the hot mill work roll and backup roll bearing assemblies 84, 94 and bearing chocks 86, 96 may be of any conventional type.

A hot mill breaker block assembly 98 having a hot mill tie bar 100 is located above the topmost backup roll assembly 76 as shown in FIG. 5. The hot mill breaker block assembly 98 is similar to the plate mill breaker block assembly 60 but the hot mill tie bar 100 is shorter than the plate mill tie bar 64. As shown in FIG. 5, the roll necks, breaker block holders 62 and the work roll and backup roll bearing chocks 86 and 98 in the hot mill configuration are substantially vertically positioned under the inner set of hold-down screws 28 and 28'.

As shown in FIGS. 3 and 5, each pair of hold-down screws is selectively adapted to substantially align with the roll necks of at least the roll adjacent the hold-down assembly 24. Either the work rolls or backup rolls of the present invention may be driven by conventional methods known in the art.

Figure 8:
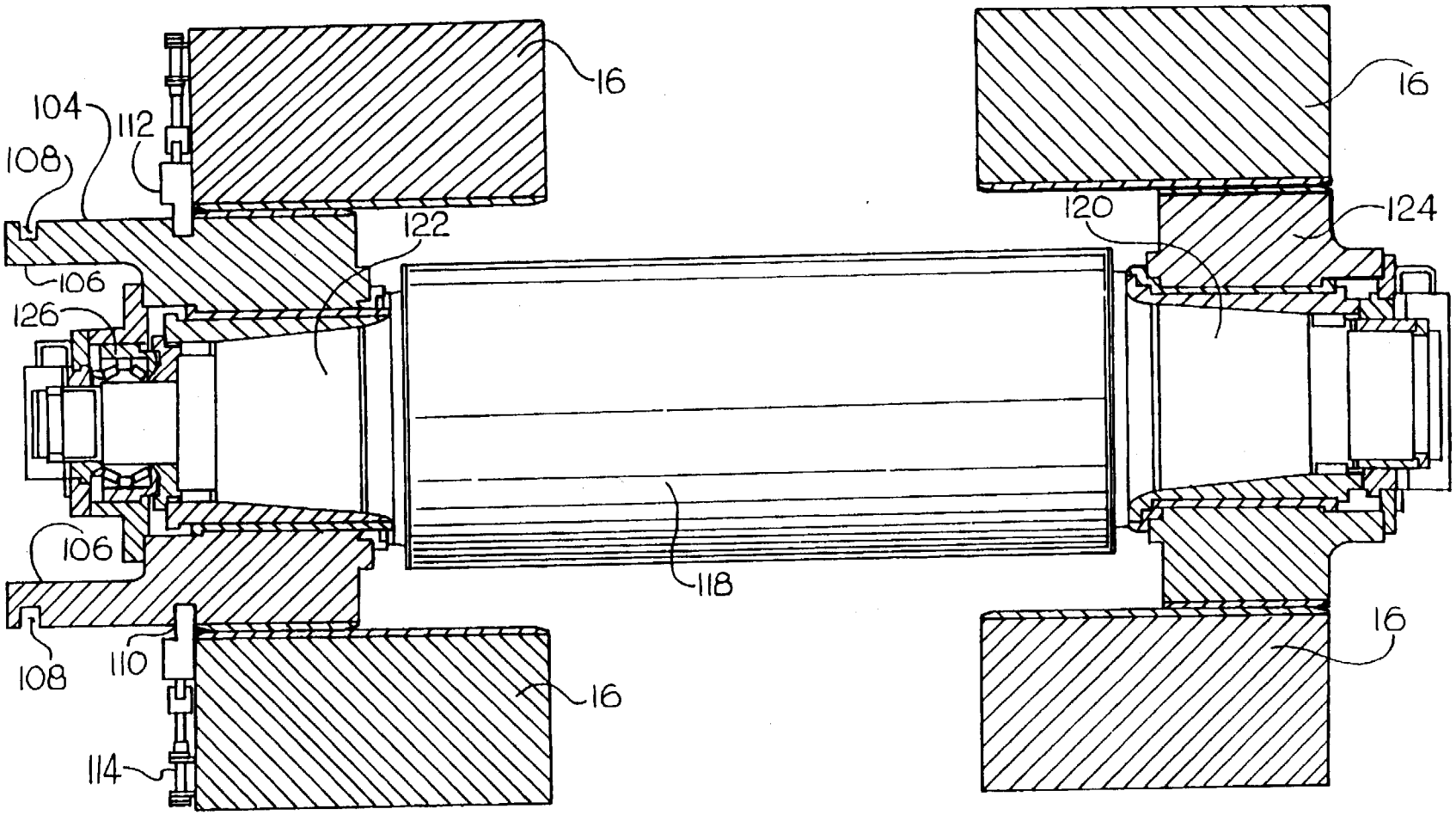
FIG. 8 is a sectional view of an alternative embodiment of a plate mill work roll assembly having a universal bearing chock.
Figure 9:
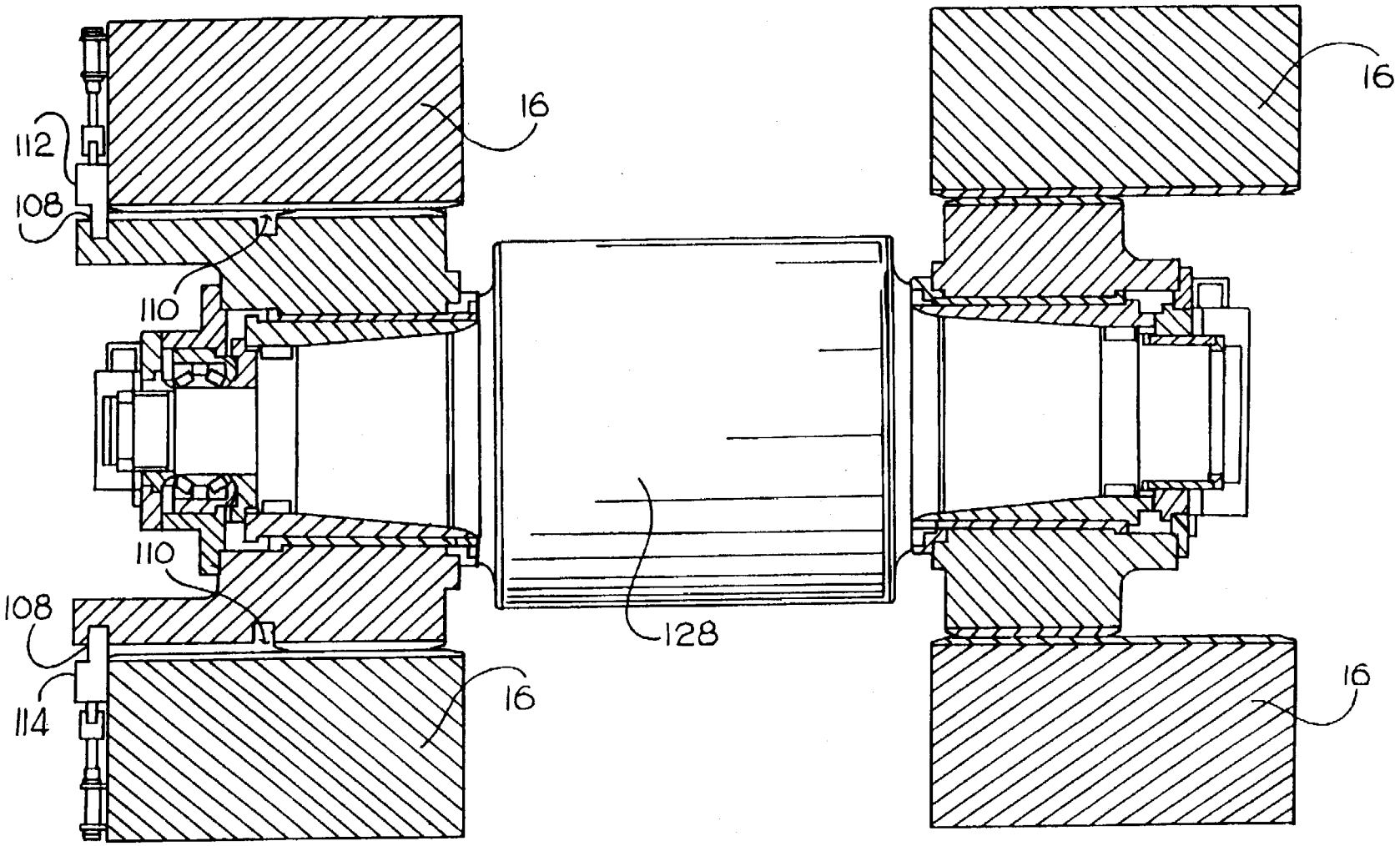
FIG. 9 is an alternative embodiment of a hot mill work roll assembly having a universal bearing chock.

A universal bearing chock 104 for use with the present invention is shown in FIGS. 8 and 9. The universal bearing chock 104 includes a pair of substantially parallel retaining ears 106. Each retaining ear 106 includes a pair of first or outer notches 108 and a pair of second or inner notches 110. As shown in FIGS. 8 and 9, retaining clamps 112 and 114 are mounted on the opposing legs 16 of each housing 12 and 14. As will be described hereinbelow, the retaining clamps 112 and 114 are configured to engage either the outer notches 108 or the inner notches 110 of the universal bearing chock 104 depending on the particular rolling embodiment being used.

Switching of the rolling mill 10 from one rolling configuration, for example a plate mill configuration, to a second configuration, such as a hot mill configuration, will now be described. FIGS. 3 and 4 show the rolling mill 10 in a plate mill configuration. In this configuration, a relatively wide work piece 116 may be rolled in conventional manner between the opposed work rolls 42. The distance between the work rolls 42 is controlled by the pair of outer hold-down screws 26, 26'. As the screws 26, 26' are lowered, the base of each screw 26, 26' contacts the breaker block assembly 60 which applies a downward force to the backup roll bearing chock 56 of the uppermost backup roll assembly 38. Movement of the outer hold-down screws 26 is accomplished in conventional manner, such as by the use of mechanical, hydraulic or electrical drive units. In this configuration, the rolling mill 10 functions as a typical plate mill for rolling relatively wide work pieces.

In order to shift from the plate mill configuration shown in FIGS. 3 and 4 to the hot mill configuration shown in FIGS. 5 and 6, the outer hold-down screws 26 are retracted and plate mill breaker block assembly 60 is lifted off of the uppermost backup roll assembly 38. The breaker block assembly 60 can be stored at a separate location or hung on a set of hooks located on the mill stand 11 until further needed. The plate mill work roll assemblies 34 and 36 and plate mill backup roll assemblies 38 and 40 are laterally removed from the mill stand 11 in conventional manner. The hot mill work roll assemblies 70 and 72 and hot mill backup roll assemblies 74 and 76 are then slid laterally into the rolling mill stand 11 and locked in place in conventional manner. The hot mill breaker block assembly 98 is placed on top of the uppermost backup roll assembly 76 and the set of inner hold-down screws 28 are lowered to contact the breaker blocks 66 of the breaker block assembly 98. Thus, the distance between the hot mill work rolls 78 can be adjusted by raising and lowering the inner hold-down screws 28, 28'. The rolling mill 10 now functions as a typical hot mill for rolling relatively narrow products. As will be evident to one skilled in the art, the mill stand 11 can be easily switched back to the plate mill configuration by simply reversing the above procedure.

The above invention permits the same rolling mill stand 11 to be used in either a plate mill or hot mill configuration. This ability negates the need to purchase and maintain separate plate mill and hot mill rolling mills. Further, the rolling mill stand 11 may be quickly and easily shifted from one rolling mill configuration to the other due to the dual purpose hold-down assembly 24 of the invention. While the above preferred embodiment relates to a typical four-high rolling mill, it will be appreciated by one skilled in the art that a similar mill stand and hold-down assembly configuration could be used with other rolling mills, such as two-high and three-high rolling mills.

While a complete rolling mill stand 11 having a hold-down assembly 24 has been described above, it will be appreciated by one skilled in the art that an existing rolling mill stand can easily be retrofitted with a hold-down assembly 24 of the present invention to permit the existing rolling mill to shift between plate mill and hot mill configurations. This can be done simply by replacing the caps of the existing rolling mill with the caps 20 and hold-down assembly 24 of the present invention. Alternatively, the caps of the existing rolling mill could be drilled and tapped to replace the typical single pair of hold-down screws with two pairs of hold-down screws 26, 26' and 28, 28' as described above. Further, by retrofitting existing mill stands, a substantial economic savings would be achieved because the existing bearing assemblies and bearing chocks of the original rolling mill could be used.

Alternatively, a universal bearing chock 104 for use with either plate mill or hot mill backup rolls could be used. FIG. 8 shows the use of the universal bearing chock 104 with a wide, plate mill backup roll 118. The backup roll 118 has a first roll neck 120 and a second roll neck 122. The first roll neck 120 is rotatably carried in a conventional bearing chock assembly 124. The second roll neck 122 is rotatably carried in a bearing assembly 126 which is itself carried in the universal bearing chock 104. As shown in FIG. 8, the universal bearing chock 104 holding the plate mill backup roll 118 is held in place by retaining clamps 112 and 114 which engage the inner notches 110 of the universal bearing chock. To shift from a plate mill to a hot mill configuration, the retaining clamps 112 and 114 are withdrawn and the backup roll 118, including the bearing chock assembly 124 and universal bearing chock 104, are removed in conventional manner from the rolling mill stand 11. As shown in FIG. 9, a hot mill backup roll 128 having a universal bearing chock 104 can then be slid in a conventional manner into the rolling mill stand 11.

Since the hot mill backup roll 128 is shorter than the plate mill backup roll 118, the universal bearing chock 104 extends further into the window 32 of the rolling mill stand 11 as shown in FIG. 9. Therefore, the retaining clamps 112 and 114 engage the outer notches 108 of the universal bearing chock 104 to lock the hot mill backup roll 128 into position.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A rolling mill, comprising:

a mill stand formed by two spaced apart housings, wherein said housings are configured to rotatably hold one of at least two sets of rolls having roll necks, wherein a length of the rolls of one of said at least two sets of rolls differs from the length of the rolls of the other of said at least two sets of rolls and wherein said at least two sets of rolls are interchangeable in said mill stand; and a hold-down assembly coupled to said housings, wherein said hold-down assembly includes at least a first pair of hold-down elements and a second pair of hold-down elements, wherein the distance between each hold-down element of said first pair of hold-down elements is less than the distance between said hold-down elements of said second pair of hold-down elements, and wherein said first pair of hold-down elements is selectively adapted to substantially align with the roll necks of the rolls of one of said at least two sets of rolls and said second pair of hold-down elements is selectively adapted to substantially align with the roll necks of the rolls of the other of said at least two sets of rolls.

2. A rolling mill as claimed in claim 1, wherein each said hold-down element is a hold-down screw.

3. A rolling mill as claimed in claim 1, wherein one of said at least two sets of rolls is a set of plate mill rolls, wherein said set of plate mill rolls includes a pair of plate mill backup roll assemblies and a pair of plate mill work roll assemblies; and wherein the other of said at least two sets of rolls is a set of hot mill rolls, wherein said set of hot mill rolls includes a pair of hot mill backup roll assemblies and a pair of hot mill work roll assemblies.

4. A rolling mill as claimed in claim 1, wherein said rolling mill is a four-high rolling mill.

5. A rolling mill as claimed in claim 2, further including at least one hold-down block, wherein at least one of said screws of said first pair of hold-down screws and at least one of said screws of said second pair of hold-down screws are each threadably engaged with said hold-down block.

6. A rolling mill as claimed in claim 2, wherein said screws of said first pair of hold-down screws are substantially equidistant from a centerline of said mill stand; and wherein the distance between said screws of said second pair of hold-down screws is substantially equidistant from said mill stand centerline.

7. A rolling mill comprising;

a mill stand formed by two spaced apart housings wherein said housings are configured to rotatably hold one of at least two sets of rolls having roll necks;

a plurality of retaining clamps mounted on said mill stand; and a hold-down assembly coupled to said housings, wherein said hold-down assembly includes at least a first pair of hold-down screws and a second pair of hold-down screws, wherein the distance between each hold-down screw of said first pair of hold-down screws is less than the distance between said hold-down screws of said second pair of hold-down screws, wherein said first pair of hold-down screws is selectively adapted to substantially align with the roll necks of the rolls of one of said at least two sets rolls and said second pair of hold-down screws is selectively adapted to substantially align with the roll necks of the other said at least two sets of rolls, and wherein at least one roll of at least one of said sets of rolls includes a universal bearing chock, wherein said universal bearing chock includes a pair of substantially parallel retaining ears, wherein each retaining ear includes an outer notch and an inner notch, and wherein said inner notch and said outer notch are configured to selectively engage said retaining clamps depending upon a selected rolling mill configuration.

8. A four-high rolling mill convertible between a plate mill configuration and a hot mill configuration, comprising:

a mill stand formed by two spaced apart housings, wherein each said housing includes a pair of substantially parallel, spaced apart legs extending substantially vertically from a base;

a cap attached to a top of each said housing and extending between the legs of said housing, wherein each said cap includes a hold-down block and a pair of threaded bores extending through said cap;

a set of plate mill rolls, wherein said set of plate mill rolls includes a pair of plate mill working roll assemblies and a pair of plate mill backup roll assemblies having bearing chocks;

a set of hot mill rolls, wherein said set of hot mill rolls includes a pair of hot mill work roll assemblies and a pair of hot mill backup roll assemblies having bearing chocks; and a hold-down assembly supported on said caps, wherein said hold-down assembly includes a pair of inner hold-down screws and a pair of outer hold-down screws, wherein said pair of inner hold-down screws is spaced closer to a centerline of said rolling mill than said pair of outer hold-down screws, wherein said pair of inner hold-down screws is selectively adapted to substantially align with the bearing chocks of an adjacent hot mill backup roll assembly, wherein said outer pair of hold-down screws is selectively adapted to substantially align with the bearing chocks of an adjacent plate mill backup roll assembly, wherein said plate mill rolls and said hot mills rolls are interchangeable in said mill stand, and wherein said plate mill rolls have a length different from said hot mill rolls.

9. A method of converting a rolling mill between a first rolling configuration and a second rolling configuration, comprising the steps of:

selectively retracting one of a first pair and second pair of hold-down elements;

removing a first set of rolls from said rolling mill;

inserting a second set of rolls having a length different from said first set into said rolling mill; and selectively extending the other of said first pair and second pair of hold-down elements.

10. The method as claimed in claim 9, wherein said hold-down elements are hold-down screws.

* * * * *